US008777212B2

(12) United States Patent
Yasukawa

(10) Patent No.: US 8,777,212 B2
(45) Date of Patent: Jul. 15, 2014

(54) MEDIUM FEEDING DEVICE

(71) Applicant: PFU Limited, Kahoku (JP)

(72) Inventor: Ryoichi Yasukawa, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 13/754,820

(22) Filed: Jan. 30, 2013

(65) Prior Publication Data

US 2013/0241144 A1 Sep. 19, 2013

(30) Foreign Application Priority Data

Mar. 19, 2012 (JP) ..... 2012-062371

(51) Int. Cl.
*B65H 3/52* (2006.01)

(52) U.S. Cl.
USPC ..... 271/124; 271/182

(58) Field of Classification Search
USPC ..... 271/124, 125, 182
See application file for complete search history.

(56) References Cited

U.S. PATENT DOCUMENTS

| | | | | |
|---|---|---|---|---|
| 4,203,586 | A * | 5/1980 | Hoyer | 271/34 |
| 5,449,162 | A * | 9/1995 | Saito et al. | 271/122 |
| 5,664,771 | A | 9/1997 | Nagatani et al. | |
| 5,678,817 | A * | 10/1997 | Saito et al. | 271/122 |
| 6,565,079 | B1 | 5/2003 | Kakegawa et al. | |
| 6,913,257 | B2 | 7/2005 | Takaki et al. | |
| 7,392,980 | B2 * | 7/2008 | Takeuchi et al. | 271/125 |
| 7,481,421 | B2 * | 1/2009 | Tsukamoto et al. | 271/110 |
| 7,832,723 | B2 * | 11/2010 | Tsukamoto et al. | 271/125 |
| 2006/0214356 | A1 | 9/2006 | Yasukawa et al. | |

FOREIGN PATENT DOCUMENTS

| | | | |
|---|---|---|---|
| JP | 2502264 | B2 | 5/1996 |
| JP | 8-217274 | A | 8/1996 |
| JP | 11-193141 | A | 7/1999 |
| JP | 2002-002993 | A | 1/2002 |
| JP | 2003-276891 | A | 10/2003 |
| JP | 3660547 | B2 | 6/2005 |
| JP | 4395085 | B2 | 1/2010 |

* cited by examiner

*Primary Examiner* — David H Bollinger
(74) *Attorney, Agent, or Firm* — McDermott Will & Emery LLP

(57) ABSTRACT

A medium feeding device 1 includes a feeding roller 3 which conveys a medium S1 in a conveying direction, a brake roller 4 that is arranged to press the feeding roller 3 with a predetermined pressure, and a separating power generating device 7 which is connected to the brake roller 4 and generates rotational load in a direction counter to the conveying direction with respect to the brake roller 4. The separating power generating device 7 includes a torque limiter 19 which generates an upper limit torque T1 which is a fixed load as a first load generating unit, and an electromagnetic brake 23 which can change the generated load as a second load generating unit. The torque limiter 19 and the electromagnetic brake 23 are connected in parallel to the brake roller 4.

5 Claims, 6 Drawing Sheets

MEDIUM FEEDING DEVICE

CROSS-REFERENCE TO RELATED APPLICATIONS

This application is based upon and claims the benefit of priority from Japanese Patent Application No. 2012-062371, filed on Mar. 19, 2012, the entire contents of which are incorporated herein by reference.

BACKGROUND OF THE INVENTION

1. Field of the Invention

The present invention relates to a medium feeding device.

2. Description of the Related Art

Conventionally, there is a known medium feeding device having a configuration in which one medium after another is conveyed as a conveyance target from among a plurality of stacked media. The medium feeding device can sequentially separate the medium of one sheet as a conveyance target from the other media and convey it by introducing the medium into between a feeding roller which conveys the medium in a conveying direction and a brake roller which generates rotational load in a direction counter to the conveying direction.

In such a medium feeding device, it is desirable to avoid a paper feed failure and/or a double feed even when a variety of media which differ in friction characteristics and/or strength are used. For example, Japanese Patent No. 3660547 discloses a technology which appropriately changes the rotational load of the brake roller by controlling an electromagnetic brake. In this way, suitable rotational load can be set for each of a variety of media. This contributes to avoidance of fault, such as a double feed.

Incidentally, there is the demand for improvement in the medium conveying speed of the medium feeding device to increase business efficiency and/or to improve cost performance. In order to secure sufficient performance of separating a medium as a conveyance target from the other media when the medium feeding device operates at a high medium conveying speed, it is necessary for the brake roller to generate the rotational load as promptly as possible when the paper feed failure and/or double feed, etc. occurs.

However, in the conventional technologies disclosed in Japanese Patent No. 3660547, etc., in general an element with large inertia, such as an electromagnetic brake, is used as an element which can change the rotational load. For this reason, when the medium conveying speed is increased, the response at the time of the brake roller generating the rotational load is deteriorated due to the influence of the inertia of a rotational load-changing component. Therefore, in such a case, there is a concern that a medium as a conveyance target may not be reliably separated from the other media.

SUMMARY OF THE INVENTION

It is an object of the present invention to at least partially solve the problems in the conventional technology.

According to an aspect of the present invention, a medium feeding device comprises a feeding roller that conveys a medium in a conveying direction, a brake roller that is arranged to press the feeding roller with a predetermined pressure, and a rotational load generating unit that is connected to the brake roller and generates rotational load in a direction counter to the conveying direction with respect to the brake roller. The rotational load generating unit includes a first load generating unit that generates a fixed load and a second load generating unit that is able to change the generated load. The first load generating unit and the second load generating unit are connected in parallel to the brake roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinbelow, embodiments of a medium feeding device according to the present invention are described based on the drawings. In the following drawings, the same reference signs denote the same or equivalent portions, and the description thereof is not repeated.

First Embodiment

Figure 1:
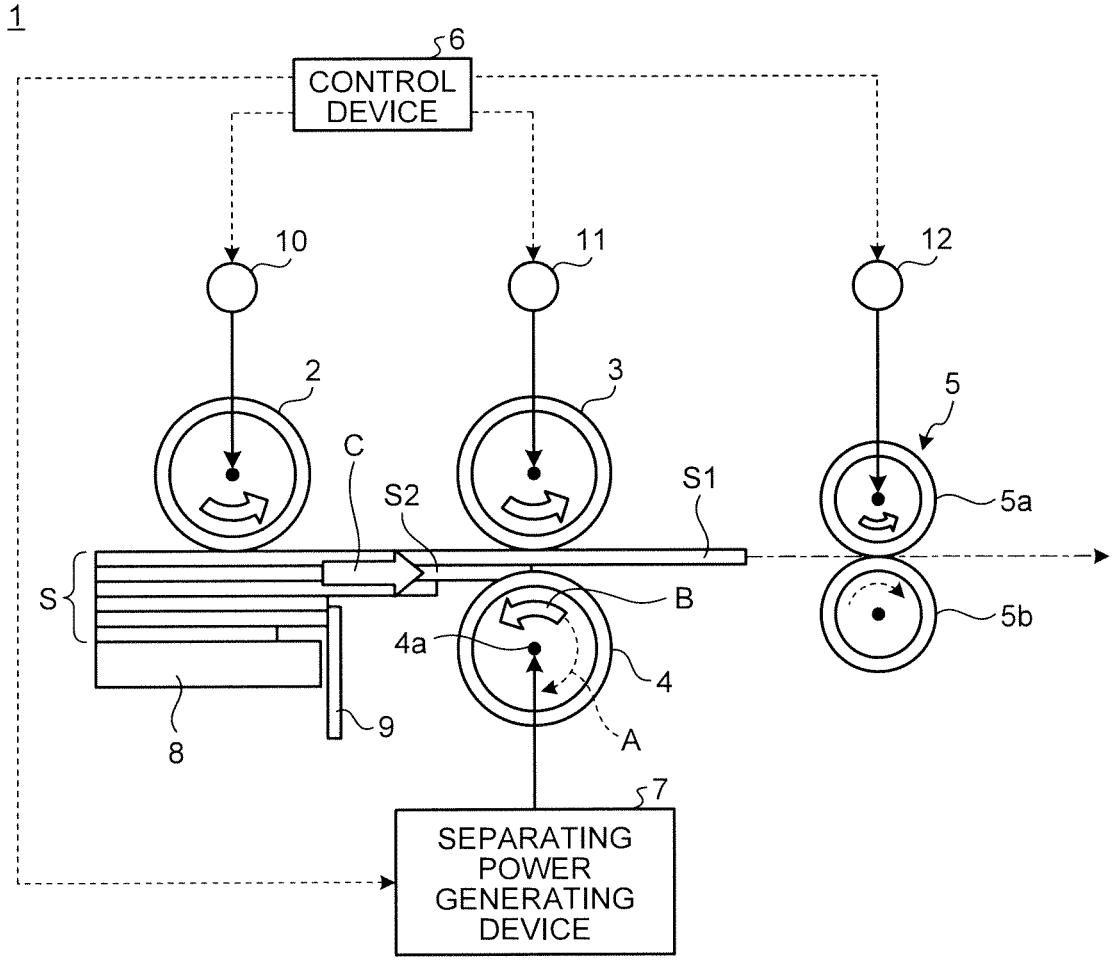
FIG. 1 is a cross-sectional view that illustrates a schematic configuration of a medium feeding device according to a first embodiment of the present invention.
Figure 2:
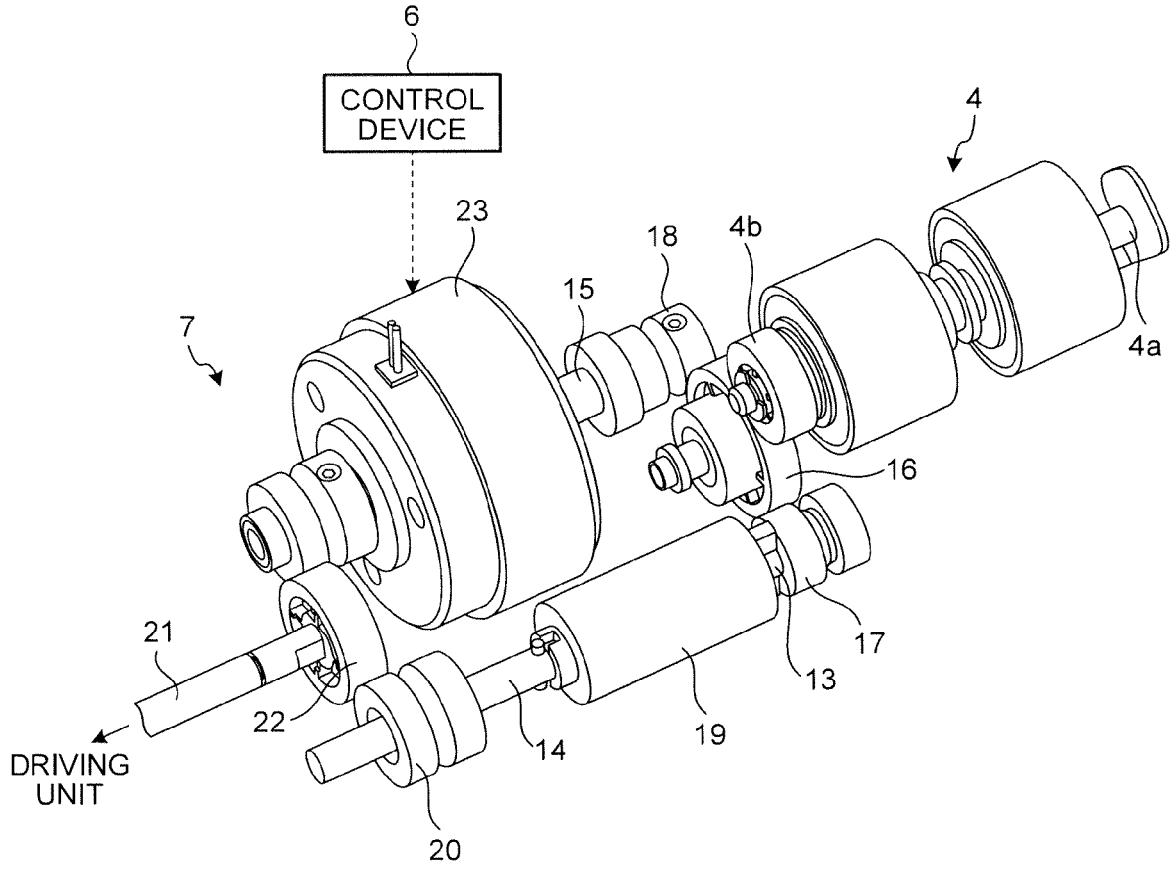
FIG. 2 is a perspective view that illustrates a schematic configuration of a separating power generating device in FIG. 1.

A first embodiment of the present invention is described with reference to FIGS. 1 and 2. FIG. 1 is a cross-sectional view illustrating the schematic configuration of a medium feeding device according to the first embodiment of the present invention, and FIG. 2 is a perspective view illustrating the schematic configuration of a separating power generating device in FIG. 1.

Referring to FIG. 1, the schematic configuration of the medium feeding device of the present embodiment is described first.

As illustrated in FIG. 1, a medium feeding device 1 according to the present embodiment is a device which separates one medium S1 after another, as a conveyance target, from a plurality of sheet-like media S, hereinafter media S, stacked on a hopper 8 and feeds the medium S1 in a conveying direction. The medium feeding device 1 is applied to an automatic paper feeder (Auto Document Feeder: ADF) mounted on image reading apparatuses, such as an image scanner, a copying machine, a facsimile, and a character recognition device, and on image forming apparatuses, such as a printer, or the like. Examples of the media S include sheet-like reading objects/print sheets, such as a manuscript and a business card, and sheet-like recording media, such as sheets of paper, for example.

The medium feeding device 1 includes a pickup roller 2, a feeding roller 3, a brake roller 4, and a conveying roller 5, all of which are provided on a conveyance path along which the media S are conveyed in the conveying direction indicated by arrow C in FIG. 1, and further includes a control device 6. The medium feeding device 1 illustrated in FIG. 1 is a medium feeding device of the upper extraction type which feeds the uppermost medium S1 among the plurality of media S mounted on the hopper 8 as a conveyance target.

The pickup roller 2 is a roller for sending out the plurality of media S stacked on the hopper 8 in the conveying direction. The pickup roller 2 is formed in a cylindrical shape in which an inner layer thereof is made of a soft material, such as, rubber foam so that a nip width may be easily formed. The pickup roller 2 is configured to be able to rotate on a rotating shaft thereof which is arranged in a direction substantially orthogonal to the conveying direction. On the upstream side of a feed gate 9 which is provided at a lower end portion in the conveying direction of the hopper 8, the pickup roller 2 is arranged so that the circumferential surface thereof can come into contact with the upper surface of the media S stacked on the hopper 8. The feed gate 9 is a member which regulates the number of sheets entering into the downstream side thereof in the conveying direction among the media S loaded on the hopper 8. The rotating shaft of the pickup roller 2 is driven to rotate along with the operation of a first motor 10 controlled by the control device 6 and thus comes into contact with the media S from above. In this way, the pickup roller 2 can send out the media S in the conveying direction.

The feeding roller 3 is a roller for feeding the uppermost sheet among the media S sent out by the pickup roller 2, which is medium S1 as a conveyance target, in the conveying direction. The feeding roller 3 is formed in a cylindrical shape in which an inner layer thereof is made of a soft material, such as, rubber foam so that a nip width may be easily formed. The feeding roller 3 is configured to be able to rotate on a rotating shaft thereof which is arranged in a direction substantially orthogonal to the conveying direction. On the downstream side of the feed gate 9 in the conveying direction, the feeding roller 3 is arranged so that the circumferential surface thereof can come into contact with the medium S1 from above the medium S1. The rotating shaft of the feeding roller 3 is driven to rotate along with operation of a second motor 11 controlled by the control device 6 and comes into contact with the medium S1 from above. In this way, the feeding roller 3 can convey the medium S1 which is the conveyance target in the conveying direction.

The brake roller 4 is a roller for preventing media S2 other than the medium S1, among the media S sent out by the pickup roller 2, from being fed in the conveying direction so that the medium S1, which is only a single sheet, serves as the conveyance target. The brake roller 4 is formed in a cylindrical shape in which an inner layer thereof is made of a soft material, such as, rubber foam so that a nip width may be easily formed. The brake roller is configured to be able to rotate on a rotating shaft 4*a* thereof which is arranged in a direction substantially orthogonal to the conveying direction.

The brake roller 4 is provided so as to face the feeding roller 3, and is in pressure-contact with the feeding roller 3. In this embodiment, "pressure-contact" means the state of pressing with arbitrary contact pressure. The arbitrary pressure is a predetermined pressure or a predetermined range of pressure to form a nip between the brake roller 4 and the feeding roller 3. Accordingly, the brake roller 4 is arranged to press the feeding roller 3 with a predetermined pressure. Since the brake roller 4 is in pressure-contact with the feeding roller 3, a nip which is the contact surfaces of both of the rollers is formed between the brake roller 4 and the feeding roller 3. The medium S1 passes through the nip between the feeding roller 3 and the brake roller 4, and is fed to the downstream side in the conveying direction. The nip width which is the length of the nip in the conveying direction is adjustable according to the degree of the pressure-contact of the brake roller 4 against the feeding roller 3.

The brake roller 4 receives torque in the conveying direction from the feeding roller 3 side due to the frictional force between the brake roller 4 and the feeding roller 3 or between the brake roller 4 and the media S. When the torque received from the feeding roller 3 side is equal to or larger than a predetermined torque of driven rotation, the brake roller 4 is idled in the conveying direction indicated by arrow A in FIG. 1, and is able to rotate along with the rotation of the feeding roller 3. When the torque received from the feeding roller 3 side is smaller than the torque of driven rotation, the brake roller 4 is driven to rotate in a direction indicated by arrow B in FIG. 1, i.e., a direction counter to the conveying direction to generate rotational load, due to the driving force transmitted from a driving unit (not illustrated). In other words, value of the rotational load generated by the brake roller 4 is limited to value of the torque of driven rotation which serves as an upper limit value.

When the brake roller 4 is in direct contact with the feeding roller 3, or when only the medium S1, i.e., only one sheet, has entered into the nip, relatively large frictional force is generated between the brake roller 4 and the feeding roller 3 or between the brake roller 4 and the medium S1. Consequently, the brake roller 4 receives the torque equal to or larger than the torque of driven rotation, and the brake roller 4 rotates along with the rotation of the feeding roller 3. On the other hand, when the double feed occurs, that is, when the medium S1 as the conveyance target and the medium S2 which is an under layer thereof enter into the nip together, the frictional force between the medium S1 and the medium S2 becomes relatively small. Consequently, the torque received from the feeding roller 3 side becomes smaller than the torque of driven rotation, and the brake roller 4 generates the rotational load of the direction counter to the conveying direction. With this rotational load, the separating power to separate the medium S2 from the medium S1 in the direction counter to the conveying direction is applied to the medium S2 so that the medium S2 may move in the direction counter to the conveying direction of the medium S1. Thus, the medium S2 entering into the nip, which is other than the medium S1 serving as the conveyance target, may be separated from the medium S1. With this operation, only the medium S1 as the conveyance target is sent out from the nip and the other medium S2 stays in the nip. As a result, the medium S2 which is other than the medium S1 of one sheet serving as the conveyance target is prevented from being fed in the conveying direction.

Such a function of the brake roller 4 is achieved by a separating power generating device 7 (a rotational load generating unit) connected to the rotating shaft 4*a* of the brake roller 4. The separating power generating device 7 is configured to be able to change the rotational load of the brake roller 4 in multiple stages. The separating power generating device 7 changes a set value of the torque of driven rotation according to the instructions from the control device 6 when the control device 6 receives a rotational load-changing command by an input operation such as operator's operation. When the separating power generating device 7 changes the torque of driven rotation, the magnitude of the rotational load generated by the brake roller 4 changes. For example, when the torque of driven rotation is increased, the rotational load also increases; and when the torque of driven rotation decreases, the rotational loads also decrease. The specific configuration of the separating power generating device 7 is described below.

The conveying roller 5 is arranged at the downstream side of the feeding roller 3 in the conveying direction, and further conveys downstream the medium S1 which has passed the feeding roller 3 in the conveying direction. The conveying roller 5 includes a driving roller 5*a* which rotates driven by a third motor 12, and a driven roller 5*b* which rotates along with the rotation of the driving roller 5*a* by being in pressure-contact with the driving roller 5*a*. The medium S1 passes between the driving roller 5*a* and the driven roller 5*b* so as to be conveyed downstream in the conveying direction.

The control device 6 controls every unit of the medium feeding device 1. As illustrated in FIG. 1, the control device 6 is connected to each of the first, second, and third motors 10, 11, and 12, and controls the rotation of the pickup roller 2 to which the first motor 10 is connected, the rotation of the feeding roller 3 to which the second motor 11 is connected, and the rotation of the conveying roller 5 to which the third motor 12 is connected.

The control device 6 is connected to the separating power generating device 7(rotational load generating unit). For example, when receiving the command of changing the operational load of the brake roller 4 through the input operation such as the operator's operation, the control device 6 performs control of changing the rotational load of the brake roller 4 by controlling the separating power generating device 7 based on this command.

After receiving the command of changing the rotational load of the brake roller 4, the control device 6 may suitably adjust the timing when to actually change the torque of driven rotation so that the rotational load of the brake roller 4 may be changed smoothly under the feeding operation of the media S. For example, the medium feeding device 1 may have another configuration in which the rotational load generating device 7 changes the rotational load in a predetermined period of time after the control device 6 determined to change the rotational load. The medium feeding device 1 may have an alternative configuration in which the rotational load generating unit changes the rotational load, at timing immediately before the media S enter the feeding roller 3, which were started to be conveyed in a predetermined period of time after the control device 6 had determined to change the rotational load.

Physically, the control device 6 is a computer which includes a CPU (Central Processing Unit), RAM (Random Access Memory), ROM (Read Only Memory), etc. All or a part of each function of the control device 6 described above is realized in a manner that application programs held in the ROM are loaded into the RAM and then executed by the CPU and, as a result, data is read out of and/or written in the RAM and/or ROM.

Next, referring to FIG. 2, the configuration of the separating power generating device 7 is described.

The separating power generating device 7 includes a first shaft 13, a second shaft 14, and a third shaft 15 which are arranged almost in parallel with the rotating shaft 4*a* of the brake roller 4. The first shaft 13 and the second shaft 14 are arranged concentrically with each other, and are arranged in parallel with the third shaft 15.

The separating power generating device 7 includes a gear 16 which meshes with a gear 4*b* pivotally supported by the rotating shaft 4*a* of the brake roller 4. The gear 16 meshes with a gear 17 pivotally supported by the first shaft 13 and with a gear 18 pivotally supported by the third shaft 15.

A torque limiter 19 (first load generating unit) is provided between the first shaft 13 and the second shaft 14. The torque limiter 19 restricts the transmission of power between the first shaft 13 and the second shaft 14 so that the torque may not exceed a predetermined upper limit torque T1. That is, when the torque equal to or larger than the upper limit torque T1 is applied to the first shaft 13 or the second shaft 14, the torque limiter 19 will interrupt the transmission of power between the first shaft 13 and the second shaft 14. An upper limit torque T1 of the torque limiter 19 is a fixed value determined according to the mechanical structure of the torque limiter 19.

A gear 20 pivotally supported by the second shaft 14 meshes with a gear 22 pivotally supported by a fourth shaft 21 arranged almost in parallel with the second shaft 14. At the end of the brake roller 4 which is on the opposite side of the gear 22, the fourth shaft 21 is connected to a driving unit, such as, a motor which is not illustrated.

That is, a power transmission path from the driving unit to the brake roller 4 is formed by the fourth shaft 21, the gear 22, the gear 20, the second shaft 14, the torque limiter 19, the first shaft 13, the gear 17, and the gear 16. The driving unit is configured to generate driving power which causes the brake roller 4 to rotate in a direction counter to the conveying direction via the power transmission path. In present embodiment, the driven rotation torque of the brake roller 4 is the upper limit torque T1 of the torque limiter 19. The torque limiter 19 can apply a fixed load torque T1 to the brake roller 4.

An electromagnetic brake 23 (second load generating unit) is provided on the third shaft 15. The electromagnetic brake 23 can generate variable braking force applied to the third shaft 15 according to the instructions from the control device 6, so that the load can be applied to the brake roller 4 via the gear 18 and the gear 16. The electromagnetic brake 23 is configured in a manner to be able to change the load applied to the brake roller 4.

As described above, since both the torque limiter 19 is connected to the gear 16 via a path of the first shaft 13 and the gear 17, and since the electromagnetic brake 23 is connected to the gear 16 via a path of the third shaft 15 and the gear 18, respectively, the torque limiter 19 and the electromagnetic brake 23 are connected in parallel to the brake roller 4 via the gear 16 and the gear 4*b*. Therefore, the rotational load, which is the sum of the load generated by the torque limiter 19 and the load generated by the electromagnetic brake 23, is generated at the brake roller 4 as the rotational load of the brake roller 4. It is possible to change the rotational load of the brake roller 4 continuously or gradually, i.e., step by step, by controlling the braking force of the electromagnetic brake 23.

Hereinbelow, the advantages of the medium feeding device according to the first embodiment are described.

The medium feeding device 1 of the present embodiment includes the feeding roller 3 which conveys the medium S1 in the conveying direction, the brake roller 4 arranged to be in pressure-contact with the feeding roller 3, and the separating power generating device 7 which is connected to the brake roller 4 and generates the rotational load exerting in the direction counter to the conveying direction with respect to the brake roller 4. The separating power generating device 7 includes the torque limiter 19 which generates the upper limit torque T1 which is a fixed load, and the electromagnetic brake 23 which can change the generated load. The torque limiter 19 and the electromagnetic brake 23 are connected in parallel to the brake roller 4.

With such a configuration, the rotational load of the brake roller 4 can be changed continuously or gradually by controlling the braking force of the electromagnetic brake 23 of the separating power generating device 7. Therefore, the rotational load of the brake roller 4 can be changed.

In the conventional technology which allows the change in the rotational load of a brake roller, an electromagnetic brake with relatively large inertia or the like was used as a component to change the rotational load. On the other hand, the medium feeding device 1 of the first embodiment uses, as means to change the rotational load, the electromagnetic brake 23 along with the torque limiter 19 which can generate fixed rotational load. This allows the electromagnetic brake 23 to be realized in a small size and reduces the influence of inertia, which improves the response at the time of generating the rotational load at the brake roller 4. As a result, even at a high medium conveying speed, the brake roller 4 can generate the rotational load promptly when a double feed and the like occur. This secures sufficient performance of separating the medium S1 as the conveyance target from the other media S2.

As described above, the medium feeding device 1 of the present embodiment can achieve both changing the rotational load of the brake roller 4 and securing sufficient performance of separating the medium S1 as the conveyance target from the other media S2 even when the medium conveying speed is increased.

Second Embodiment

Figure 3:
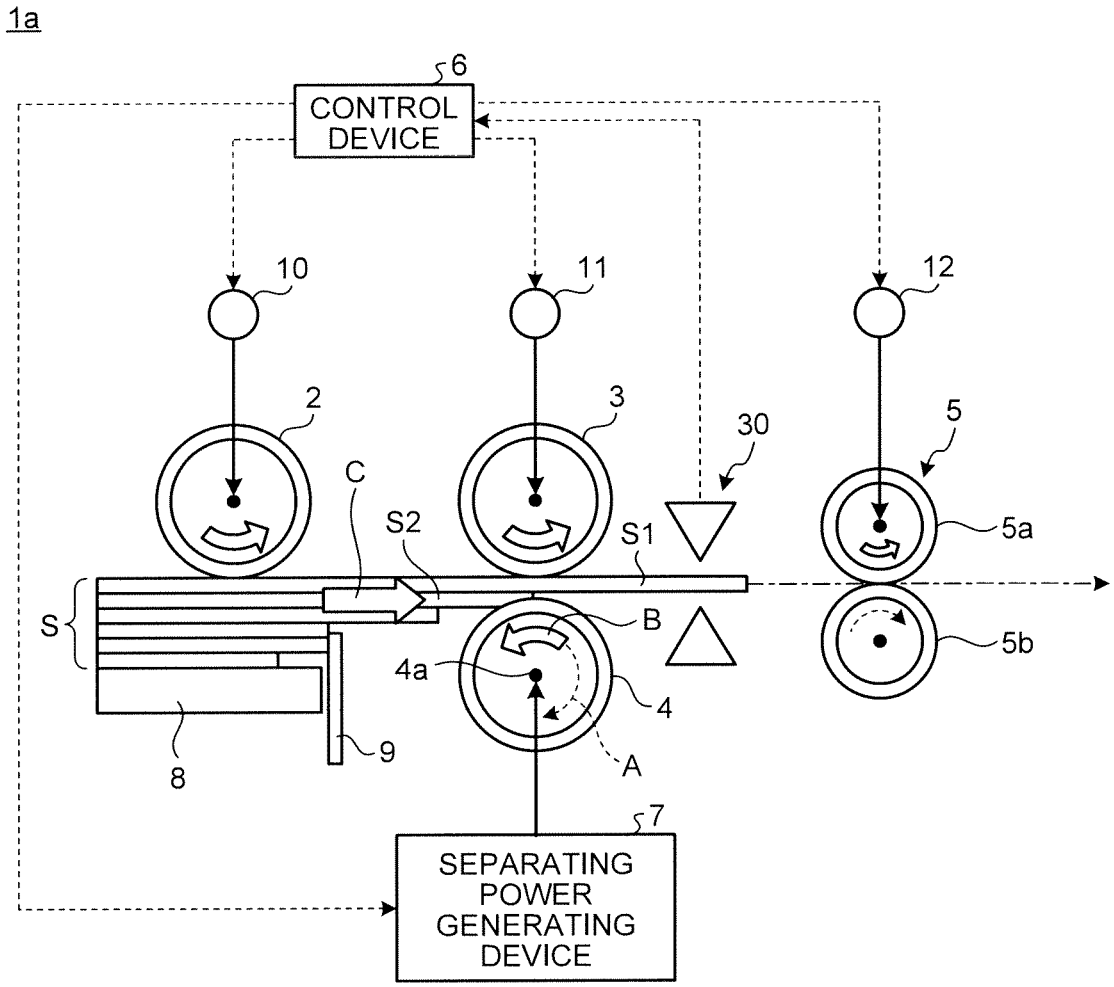
FIG. 3 is a cross-sectional view that illustrates a schematic configuration of a medium feeding device according to a second embodiment of the present invention.
Figure 4:
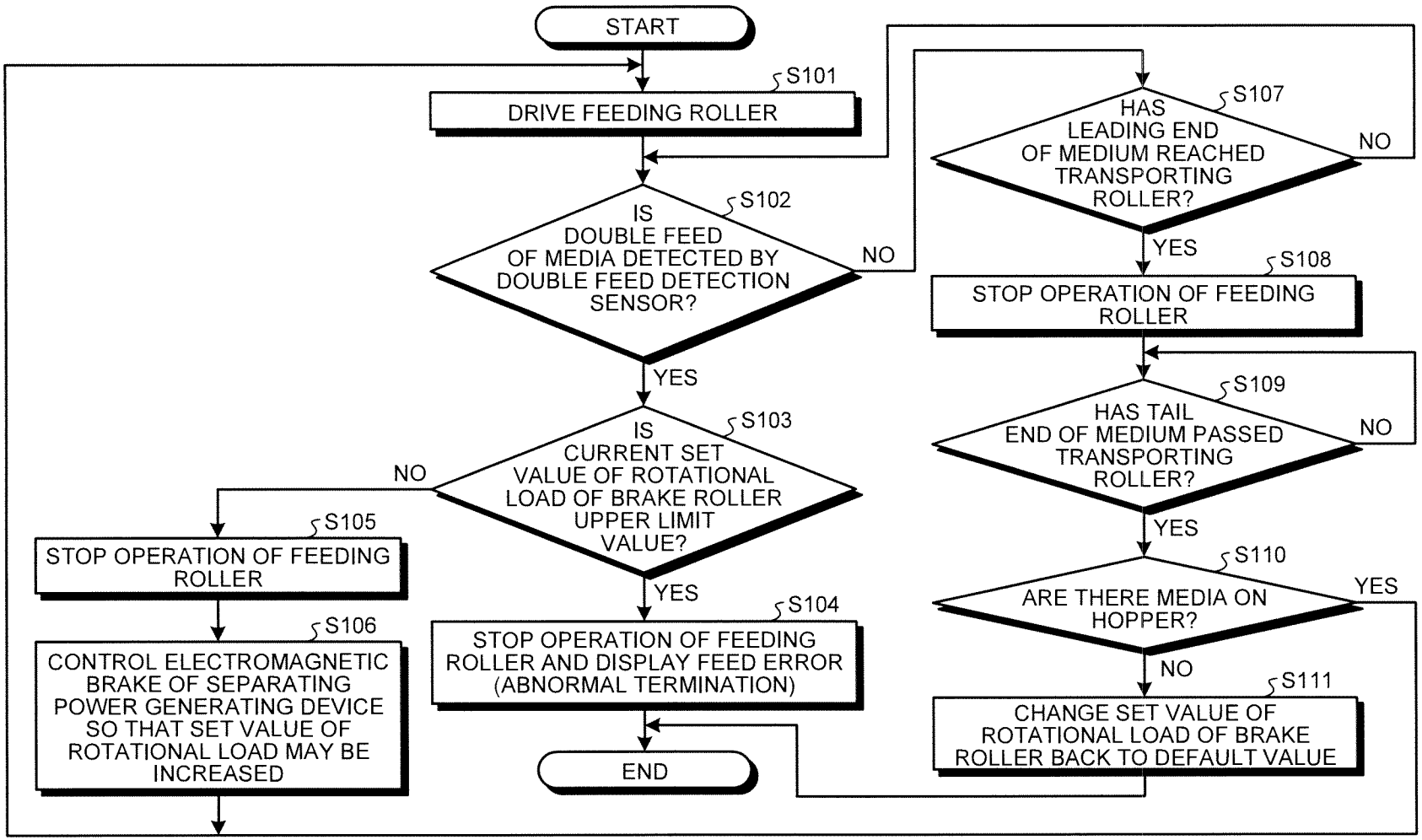
FIG. 4 is a flowchart which illustrates rotational load change processing of a brake roller in the second embodiment of the present invention.

Next, a second embodiment of the present invention is described with reference to FIGS. 3 and 4. FIG. 3 is a sectional view illustrating the schematic configuration of a medium feeding device according to the second embodiment of the present invention, and FIG. 4 is a flowchart illustrating rotational load change processing of a brake roller in the second embodiment of the present invention.

As illustrated in FIG. 3, a medium feeding device 1*a* of the second embodiment is different from the medium feeding device 1 of the first embodiment in that it is equipped with double feed detection sensors 30 (double feed detection units) which are provided downstream of a brake roller 4 in a conveying direction to detect a double feed of media S, and in that a control device 6 controls a separating power generating device 7 so that the rotational load of the brake roller 4 may be increased when the double feed of the media S is detected by the double feed detection sensors 30.

A pair of the double feed detection sensors 30 are arranged at both sides of a conveyance path of the media S, such that the double feed detection sensors 30 face each other along a thickness direction of the media S. In addition, when the media S pass through a gap between the sensors facing each other, the sensors detect that two or more sheets of the media S are conveyed in an overlapping state. When the double feed of the media S is detected, the double feed detection sensors 30 transmit information of the detection of the double feed to the control device 6.

A state where the double feed of the media S is detected by the double feed detection sensors 30, is a state in which the media S of two or more sheets are sent out downstream in the conveying direction, from a nip between a feeding roller 3 and the brake roller 4. In order to cancel this state, the control device 6 controls the separating power generating device 7 so that the torque of driven rotation of the brake roller 4 may be increased according to the detection of the double feed by the double feed detection sensors 30. Specifically, the control device 6 increases the braking force of the electromagnetic brake 23 of the separating power generating device 7. In this way, the rotational load of the brake roller 4 is increased and thus stronger separating power can be applied to the media S2 which are other than the conveyance target and are about to enter into the nip between the feeding roller 3 and the brake roller 4. This promotes separation of the media S2 from the medium S1 which is the conveyance target.

Referring to FIG. 4, the schematic configuration of a medium feeding device 1*a* of the present embodiment is described.

The feeding roller 3 is driven first (Step S101), and the feeding roller 3 sends out the media S to the downstream side in the conveying direction. When the leading ends of the media S sent out from the feeding roller 3 reach the detection range of the double feed detection sensors 30, the double feed detection sensors 30 check whether there is the overlap of a plurality of media S (Step S102).

When the overlap of the media S is detected in Step S102 (Yes in Step S102), subsequently, it is checked whether a current set value of the rotational load of the brake roller 4 is an upper limit value (Step S103). When the current set value of the rotational load of the brake roller 4 is the upper limit value (Yes in Step S103), the double feed of the media S occurs even if the rotational load of the brake roller 4 is set to the maximum and thus it is assumed that a certain failure has occurred in the medium feeding device 1*a*. Therefore, the operation of the feeding roller 3 is stopped, and a feed error is displayed to an operator. As a result, the operation is terminated as abnormal termination (Step S104).

When the current set value of the rotational load of the brake roller 4 is not the upper limit value (No in Step S103), in order to suppress the double feed of the media S, the operation of the feeding roller 3 is stopped (Step S105) and the electromagnetic brake 23 of the separating power generating devices 7 is controlled so that the set value of the rotational load of the brake roller 4 may be increased (Step S106). Then, the processing returns to Step S101. Specifically, the control device 6 increases the rotational load of the brake roller 4 by increasing the braking force of the electromagnetic brake 23 of the separating power generating device 7.

When the overlap of the media S is not detected in Step S102 (No in Step S102), subsequently, it is checked whether the leading end of the medium S1 has reached the conveying roller 5 (Step S107). When the medium S1 has not reached the conveying roller 5 (No in Step S107), the processing returns to Step S102.

When the medium S1 has reached the conveying roller 5 in Step S107 (Yes in Step S107), the operation or drive of the feeding roller 3 is stopped (Step S108) and the medium S1 is conveyed downstream by the conveying roller 5. Standing by until the tail end of the medium S1 passes the conveying roller 5 (No in Step S109), after the tail end of the medium S1 has passed the conveying roller 5 (Yes in Step S109), it is checked whether there are other media S on the hopper 8 (Step S110). When there are the media S on the hopper 8 (Yes in Step S110), the processing returns to Step S101. When there is no media S on the hopper 8 (No in Step S110), the set value of the rotational load of the brake roller 4 is changed back to a default value (Step S111), and the processing ends.

The flowchart of FIG. 4 illustrates, for example, a configuration in which, after all the media S on the hopper 8 are sent out, the set value of the rotational load of the brake roller 4 is changed back to the default value. However, the medium feeding device 1*a* may have another configuration in which the set value of the rotational load is changed back to the default value at another timing, for example, after a predetermined period passes, or after a predetermined number of the media S are conveyed. The medium feeding device 1*a* may have an alternative configuration in which the changed set value of the rotational load is stored without being changed back to the default value at the time of the end of the rotational load change processing illustrated in FIG. 4, and the stored set value of the rotational load is used at the time of executing next rotational load change processing.

Third Embodiment

Figure 5:
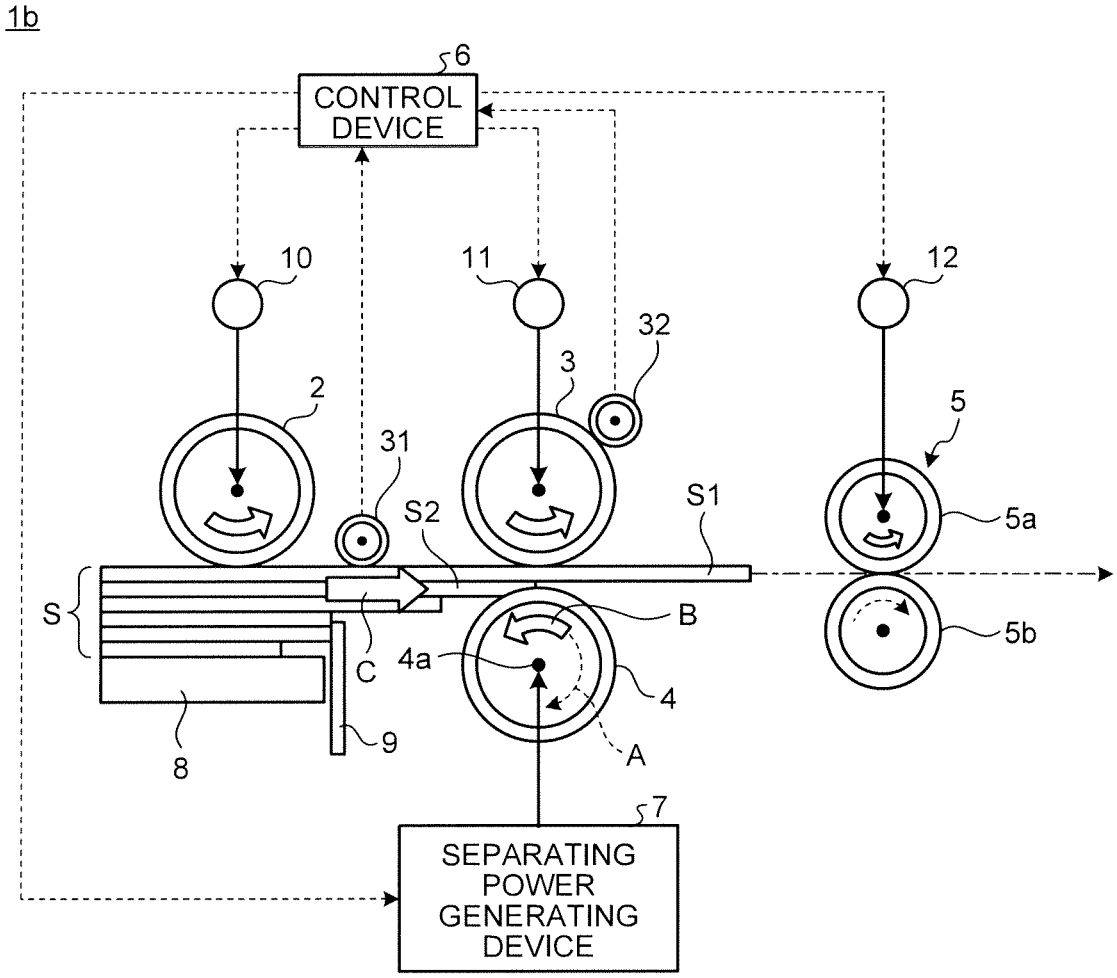
FIG. 5 is a cross-sectional view that illustrates a schematic configuration of a medium feeding device according to a third embodiment of the present invention.
Figure 6:
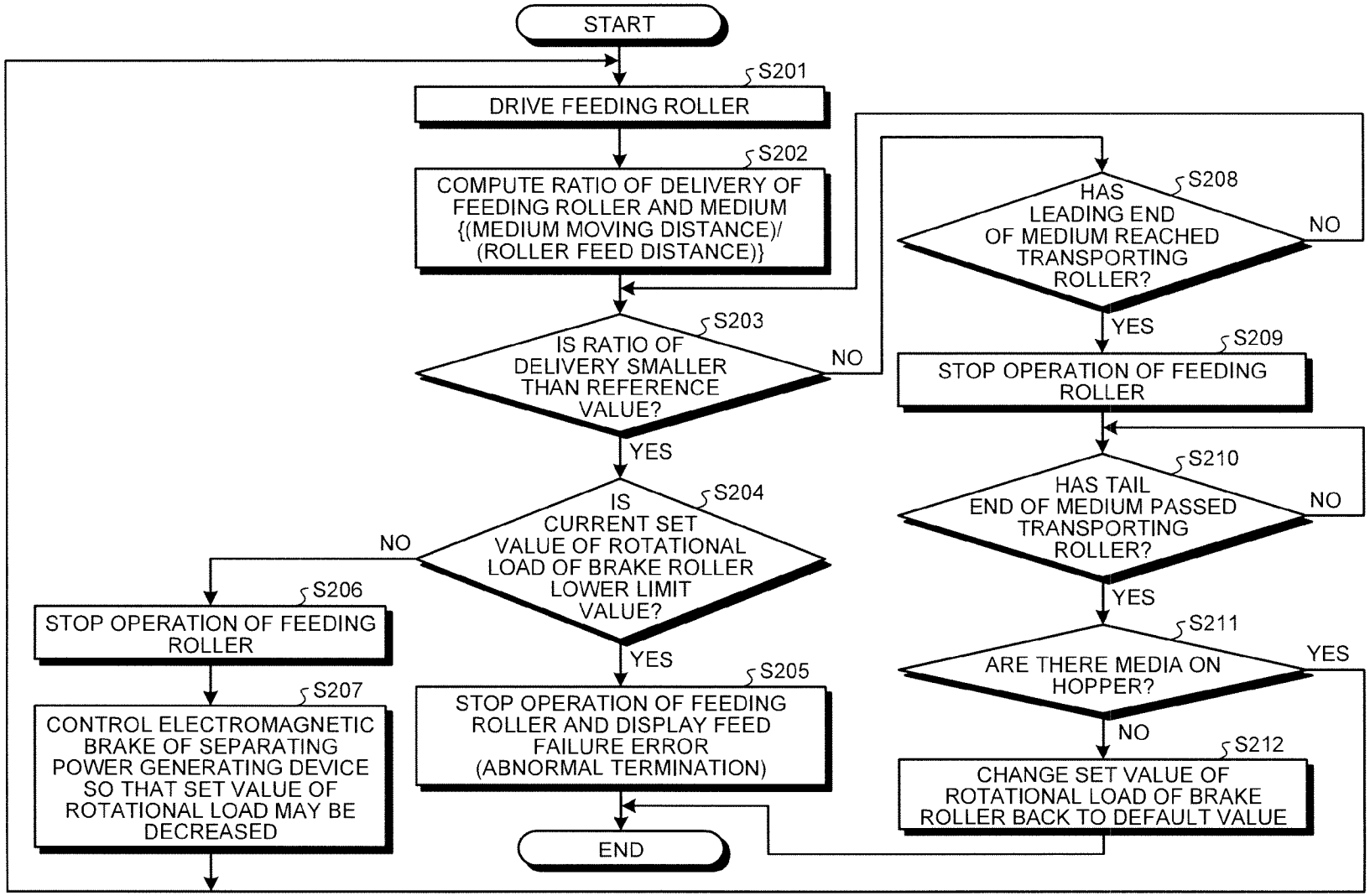
FIG. 6 is a flowchart which illustrates rotational load change processing of a brake roller in the third embodiment of the present invention.

Next, a third embodiment of the present invention is described with reference to FIGS. 5 and 6. FIG. 5 is a cross-sectional view illustrating the schematic configuration of a medium feeding device according to the third embodiment of the present invention, and FIG. 6 is a flowchart illustrating rotational load change processing of a brake roller in the third embodiment of the present invention.

As illustrated in FIG. 5, a medium feeding device 1*b* of the present embodiment differs from the medium feeding device 1 of the first embodiment and the medium feeding device 1*a* of the second embodiment in that it is equipped with an encoder 31 which detects a moving distance of a medium S1 which enters into a feeding roller 3 and an encoder 32 which detects a feed distance of the feeding roller 3, and in that a control device 6 performs control of changing the rotational load of a brake roller 4 based on a ratio of the feed distance of the feeding roller 3 and the moving distance of the medium S1 which enters the feeding roller 3.

The encoder 31 is arranged between a pickup roller 2 and the feeding roller 3, and measures the amount of movement of the medium S1 sent out by the pickup roller 2 toward the feeding roller 3, for example. The encoder 32 is arranged to be in contact with the circumferential surface of the feeding roller 3, for example. The encoder 32 measures the feed distance of the feeding roller 3 by being driven to rotate along with the rotation of the feeding roller 3.

The control device 6 computes the ratio of delivery of the feeding roller 3 and the medium S1, that is (medium moving distance)/(roller feed distance of a feeding roller), based on the amount of movement of the medium S1 measured by the encoder 31, and the feed distance of the feeding roller 3 measured by the encoder 32. When the ratio of delivery is less than 1, it indicates a state in which slip occurs between the feeding roller 3 and the medium S1. When the ratio of delivery is smaller than a reference value which is less than 1, the control device 6 assumes that the rotational load of the brake roller 4 is so excessive that the conveyance of the medium S1 by the feeding roller 3 is impeded, and thus controls a separating power generating device 7 so that the rotational road of the brake roller 4 may be reduced. Specifically, the control device 6 reduces the braking force of the electromagnetic brake 23 of the separating power generating device 7. In this way, the rotational load of the brake roller 4 can be changed to an appropriate value, and the slip between the feeding roller 3 and the medium S1 can be suppressed.

Referring to FIG. 6, the schematic configuration of the medium feeding device 1*b* of the present embodiment is described.

The feeding roller 3 is driven first (Step S201), and the feeding roller 3 sends out a medium S1 to the downstream side in the conveying direction. At this time, the encoder 31 measures the amount of movement (medium moving distance) of the medium S1 which is sent out from the pickup roller 2 to the feeding roller 3, and the encoder 32 measures the feed distance (roller feed distance) of the feeding roller 3. Based on these measurement values, the ratio of delivery of the feeding roller 3 and the medium S1, i.e., (medium moving distance)/(roller feed distance), is computed (Step S202).

Then, it is checked whether the ratio of delivery computed in Step S202 is smaller than the reference value which is less than 1 (Step S203). When the ratio of delivery is smaller than the reference value (Yes in Step S203), subsequently, it is checked whether a current set value of the rotational load of the brake roller 4 is a lower limit value or not (Step S204). When the current set value of the rotational load of the brake roller 4 is the lower limit value (Yes in Step S204), it is determined that the slip exceeding tolerance occurs between the feeding roller 3 and the medium S1 even if the rotational load of the brake roller 4 is set to the minimum. Therefore, it is assumed that a certain failure occurs in the medium feeding device 1*b*. Therefore the operation of the feeding roller 3 is stopped and a feed error is displayed to an operator. As a result, the operation is terminated as abnormal termination (Step S205).

When the current set value of the rotational load of the brake roller 4 is not the lower limit value (No in Step S204), in order to suppress the slip between the feeding roller 3 and the medium S1, the operation of the feeding roller 3 is stopped (Step S206) and the electromagnetic brake 23 of the separating power generating devices 7 is controlled so that the set value of the rotational load of the brake roller 4 may be decreased (Step S207). Then, the processing returns to Step S201. Specifically, the control device 6 decreases the rotational load of the brake roller 4 by decreasing the braking force of the electromagnetic brake 23 of the separating power generating device 7.

When the ratio of delivery is equal to or larger than the reference value in Step S203 (No in Step S203), subsequently, it is checked whether the leading end of the medium S1 has reached a conveying roller 5 (Step S208). When the medium S1 has not reached the conveying roller 5 (No in Step S208), the processing returns to Step S203.

When the medium S1 has reached the conveying roller 5 in Step S208 (Yes in Step S208), the operation or drive of the feeding roller 3 is stopped (Step S209) and the medium S1 is conveyed downstream by the conveying roller 5. Standing by until the tail end of the medium S1 passes the conveying roller 5 (No in Step S210), after the tail end of the medium S1 has passed the conveying roller 5 (Yes in Step S210), it is checked whether there are other media S on the hopper 8 (Step S211). When there are the media S on the hopper 8 (Yes in Step S211), the processing returns to Step S201. When there is no media S on the hopper 8 (No in Step S211), the set value of the rotational load of the brake roller 4 is changed back to a default value (Step S212), and the processing ends.

The flowchart of FIG. 6 illustrates, for example, a configuration in which, after all the media S on the hopper 8 are sent out, the set value of the rotational load of the brake roller 4 is changed back to the default value. However, the medium feeding device 1*b* may have another configuration in which the set value of the rotational load is changed back to the default value at another timing, for example, after a prescribed period passes, or after a predetermined number of the media S are conveyed. The medium feeding device 1*b* may have an alternative configuration in which the changed set value of the rotational load is stored without being changed back to the default value at the time of the end of the rotational load change processing illustrated in FIG. 6, and the stored set value of the rotational load is used at the time of executing next rotational load change processing.

The flowchart of FIG. 6 illustrates an exemplary configuration in which, when the ratio of delivery is smaller than a reference value, the set value of the rotational load of the brake roller 4 is decreased. However, instead of decreasing the rotational load of the brake roller 4, the rotational load may be increased when the ratio of delivery is larger than reference value.

The above-mentioned embodiments are described in connection with, for example, a medium feeding device of the type which includes a driving unit, such as a motor which causes a brake roller to rotate in a conveying direction and a counter direction, i.e., a medium feeding device of an FRR (Feed & Reverse Roller) Paper Feed System (hereinafter, FRR system). However, techniques other than the FRR system, such as a technique of a simplified FRR system in which the rotating shaft 4*a* of the brake roller 4 does not rotate in the direction counter to the conveying direction may be applied, as long as the technology is able to generate the rotational load with respect to the brake roller 4. The separating power generating device 7 may have a configuration in which no driving unit is equipped and the fourth shaft 21 connected to the driving unit is fixed to a fixed end so as not to be rotatable.

In addition, the above-mentioned embodiments are described in connection with the medium feeding device of the upper extraction type which feeds the uppermost medium S1 among the media S stacked on the hopper 8 as a conveyance target, the present invention is also applicable to the type which supplies, as the conveyance target, the lowermost medium of one sheet among a plurality of media S stacked on the hopper 8, that is, the so-called lower extraction type.

The medium feeding device according to the present invention has the advantages of capable of changing the rotational load of the brake roller, and securing the sufficient performance of separating a medium as a conveyance target from the other media even when the medium conveying speed is increased.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A medium feeding device comprising:

a feeding roller that conveys a medium in a conveying direction;

a brake roller that is arranged to press the feeding roller with a predetermined pressure; and a rotational load generating unit that is connected to the brake roller and generates rotational load in a direction counter to the conveying direction with respect to the brake roller, wherein the rotational load generating unit includes a first load generating unit that generates a fixed load and a second load generating unit that generates variable load, the first load generating unit and the second load generating unit are connected in parallel to the brake roller via a transmission unit, and the rotational load is a sum of the fixed load generated by the first load generating unit and the variable load generated by the second load generating unit.

2. The medium feeding device according to claim 1, further comprising a control device that controls the medium feeding device, wherein the rotational load generating unit changes the rotational load in a predetermined period of time after the control device determines to change the rotational load.

3. The medium feeding device according to claim 1, further comprising a control device that controls the medium feeding device, wherein the rotational load generating unit changes the rotational load immediately before media enter the feeding roller, conveyance of the media being started in a predetermined period of time after the control device determines to change the rotational load.

4. The medium feeding device according to claim 1, further comprising: a double feed detection unit that is provided downstream of the brake roller and detects a double feed of media, wherein the rotational load generating unit increases the rotational load when the double feed of the media is detected by the double feed detection unit.

5. The medium feeding device according to claim 1, wherein the rotational load generating unit changes the rotational load, based on a ratio between a feed distance of the feeding roller and a moving distance of the medium that enters the feeding roller.

* * * * *